US006374841B1

(12) United States Patent
Yamamoto et al.

(10) Patent No.: US 6,374,841 B1
(45) **Date of Patent: *Apr. 23, 2002**

(54) FLEXIBLY ELASTIC TIP FOR STICK USE AND STICK SHOD WITH THE SAME

(75) Inventors: Yoshikazu Yamamoto; Yasuo Nomura, both of Hiratsuka (JP)

(73) Assignee: Kabushiki Kaisha Daiwa, Kanagawa-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,770

(22) Filed: Mar. 23, 1999

(30) Foreign Application Priority Data

Jun. 2, 1998 (JP) ..... 10-152928
Jan. 13, 1999 (JP) ..... 11-006922

(51) Int. Cl.[7] ..... A45B 9/04
(52) U.S. Cl. ..... 135/77; 135/82; 135/84; 135/86; 248/188.9
(58) Field of Search ..... 135/77, 84, 82, 135/86, 910; 248/188.9

(56) References Cited

U.S. PATENT DOCUMENTS 994,194 A * 6/1911 Pratt ..... 135/82
1,314,193 A * 8/1919 Hipwood ..... 135/82
2,675,014 A * 4/1954 Powers ..... 135/82
2,910,995 A * 11/1959 Jacuzzi ..... 135/77
3,040,757 A * 6/1962 Smith ..... 135/86
3,467,117 A * 9/1969 Lucibello ..... 135/77
3,741,226 A * 6/1973 Urban ..... 135/86 X
4,135,536 A * 1/1979 Willis ..... 135/84
5,425,388 A * 6/1995 Chen et al. ..... 135/48 X
5,653,468 A * 8/1997 Ostapyk ..... 135/66 X
5,699,819 A * 12/1997 Simons ..... 135/82
5,810,038 A * 9/1998 Carpinella ..... 135/77

FOREIGN PATENT DOCUMENTS

CH 610501 * 4/1979 ..... 135/910
JP 10-152928 6/1998
JP 11-006922 1/1999

* cited by examiner

*Primary Examiner*—Carl D. Friedman
*Assistant Examiner*—Winnie Yip
(74) *Attorney, Agent, or Firm*—James Creighton Wray; Meera P. Narasimhan

(57) ABSTRACT

An object of the invention is to provide a tip for stick use without any movable portion and any sliding portion, which is monolithically formed to be flexibly deformable having a restoring function as well as a simple constitution, and a stick shod with the same. The tip is mainly constituted of a lower portion 1 for contacting the ground, an upper portion 2 whereon a hole 6 to be inserted with the stick 3 is opened and a flexibly deformable portion 4 for connecting aforesaid lower portion 1 and upper portion 2 which is equipped with an annular concavity 5 on a peripheral surface. The above-mentioned three portions 1, 2 and 4 constituting the tip are fabricated monolithically from an elastic material.

10 Claims, 3 Drawing Sheets

FLEXIBLY ELASTIC TIP FOR STICK USE AND STICK SHOD WITH THE SAME

BACKGROUND OF THE INVENTION

1. Field of the Invention

The present invention relates to a flexibly elastic tip for various sorts of sticks use such as a single-handed cane, a crutch etc. and, in more particular, to those for stick use, which are targeted for aged persons, for physically handicapped persons and for rehabilitation of patients, and a stick shod with the same.

2. Brief Description of the Drawings

Various sorts of those sticks have been well known so far and almost all of those sticks are equipped respectively with an elastic tip formed of such as rubber etc. on a lowermost end of the stick.

In recent years, a flexibly movable tip employing a ball-and-socket joint has been known.

In the former elastic tip mentioned above, the tip can attain an initial object of preventing the stick from slipping if the stick is used so as to be kept perpendicular with respect to the ground. However, on an ordinary walk, as the stick is frequently used slant with respect to the ground due to difficulty of keeping the stick perpendicular to the ground such as on a slope, on steps etc., the tip is liable to contact with the ground so as not to exhibit an enough slip prevention effect because of a lack in contact area between the tip and the ground. Namely, there is a problem that the slip prevention effect inherent to the tip does not guarantee users with a high safety.

On the other hand, although the latter tip solves the problem and the deficiency of the former tip, a structure of the tip turns complicated because it is constituted of the ball-and-socket. Beside that, a movable portion which embraces the ball appears outside being exposed as a sliding part so that dusts and sands dispersed on a road surface are liable to invade into an inside through a discrepancy formed between the movable portion and the ball, resulting in another problem that they would be an origin of mechanical failures.

SUMMARY OF THE INVENTION

The present invention is carried out to solve the problems mentioned above. An object of the invention is to provide a tip for stick use including neither a movable portion nor a sliding part, which is monolithically formed as a whole, flexibly deformable and simply constituted to have a restoring function, and a stick shod with the same.

The present invention can solve the problems mentioned above if it is constituted as follows:

(1) A flexibly elastic tip for stick use, comprising:

a lower portion of the tip for contacting the ground;

an upper portion of the tip on which a stick inserting hole to be inserted with the stick is opened; and a flexibly deforming portion for connecting the lower portion and the upper portion which is equipped with an annular concavity on a peripheral surface, wherein: the three portions mentioned above are monolithically formed of an elastic material as a whole.

(2) A flexibly elastic tip for stick use, comprising:

a lower portion of the tip for contacting the ground;

upper portion of the tip on which a stick inserting hole to be inserted with the stick is opened; and a flexibly deforming portion for connecting the lower portion and the upper portion which is equipped with an annular concavity on a peripheral surface, wherein: the three portions mentioned above are monolithically formed of an elastic material as a whole; and a reinforcement material for reinforcing the elastic material such as a spring coil, a cord etc. is embedded and fixed inside the elastic material.

(3) The flexibly elastic tip according to the constitution described either in (1) or in (2), wherein:

a tubular metal is coated on an inside wall of the hole which is opened on the upper portion of the tip.

(4) The flexibly elastic tip according to the constitution described either in (1) or in (2), wherein:

a tubular metal is coated on an inside wall of the hole which is opened on the upper portion of the tip; and a light reflecting material is coated on an outside periphery of the upper portion of the tip.

(5) A stick shod with the tip described in (1) on a lowermost end of the stick.

(6) A stick shod with the tip described in (2) on a lowermost end of the stick.

(7) A stick shod with the tip described in (3) on a lowermost end of the stick.

(8) A stick shod with the tip described in (4) on a lowermost end of the stick.

DETAILED DESCRIPTION OF THE PREFERRED EMBODIMENTS

Figure 1:
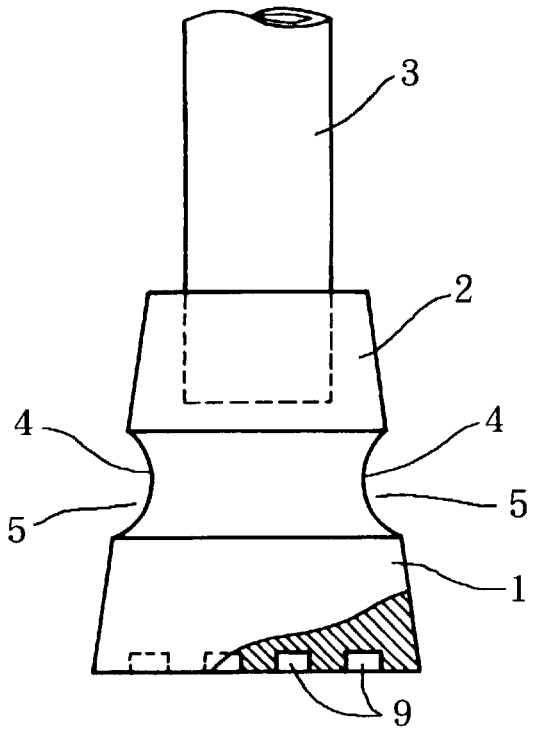
FIG. 1 is a partly cross-sectioned side view showing an embodiment of an flexibly elastic tip for stick use according to the present invention.

Hereinafter are detailed the preferred embodiments according to the present invention with reference to the drawings of FIG. 1 to FIG. 5D. The best modes contemplated by the inventors during carrying out the invention into practice will also be described corresponding to the preferred embodiments.

In each figure, a numeric sign 1 stands for a lower portion for grounding of a tip, 2 stands for an upper portion of the tip which is equipped to a lower end of a stick 3, 4 stands for a flexibly deformable portion which is formed between aforesaid lower portion 1 and aforesaid upper portion 2 to connect both portions and equipped with an annular concavity 5 on a surface. The lower portion 1, the flexibly deformable portion 4 and the upper portion 2 of the tip are monolithically fabricated by an elastic material such as rubber, plastic resin etc. to form an elongated truncated cone. Herein 6 stands for a hole opened on a front end of the upper portion 2 of the tip whereto an lower end of the stick can be inserted and fixed.

Embodiments shown in FIGS. 2, 3, 4A and 4B illustrate constitutions wherein each reinforcement member 7 is embedded and fixed inside the tip to be compared with the previous embodiment shown in FIG. 1.

Figure 2:
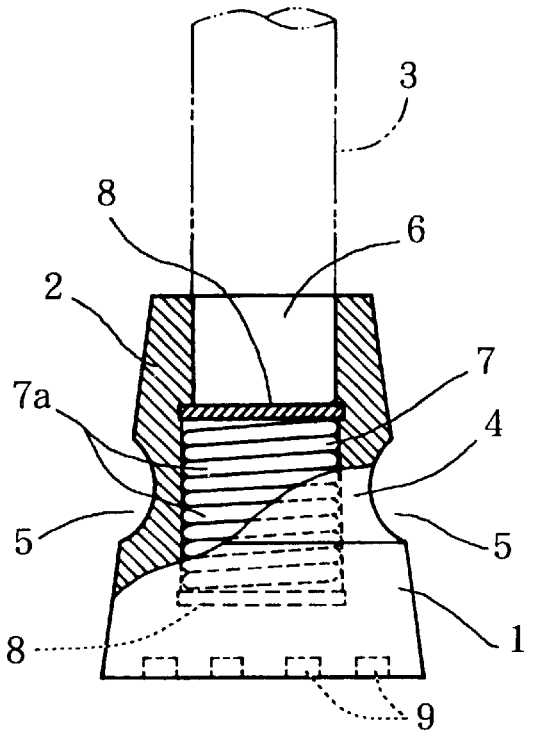
FIG. 2 is another partly cross-sectioned side view showing another embodiment according to the present invention.

In the embodiment shown in FIG. 2, a coil spring 7*a* having a desirable elastic strength is built-in inside the tip, of which location corresponds substantially to a height of the annular concavity 5 or, otherwise, the tip is monolithically formed, for instance, by a transfer molding technology using a die, the coil spring 7*a* being included inside. Circular check plates 8 and 8 are preferably contacted with the coil spring 7*a* on an upper end and a lower end. The circular check plates 8 and 8 are also integrally fabricated either employing the die to form the tip or being embedded together with the coil spring 7*a* into the inside of the tip.

When the built-in technology is employed, the embedment and the fixing of the circular plates 8 and 8 are herein easily attainable together with those of the coil spring 7*a* if you utilize aforesaid hole 6 which is opened deeply into the tip.

Figure 3A:
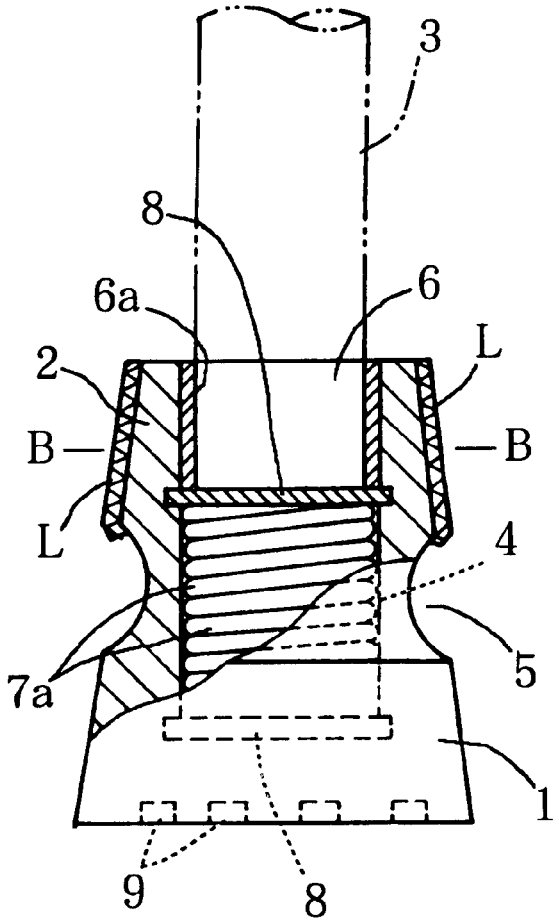
FIG. 3A is still another partly cross-sectioned side view showing still another embodiment according to the present invention.
Figure 3B:
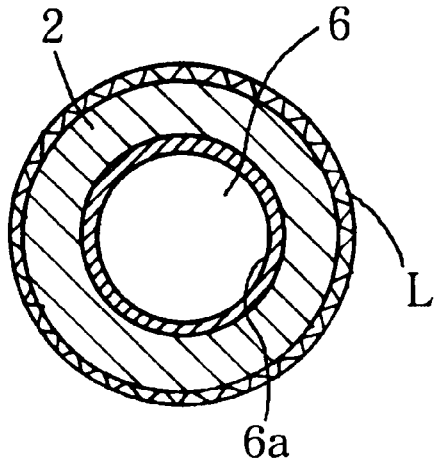
FIG. 3B is a horizontally cross-sectioned view of FIG. 3A taken along a line of B—B.

In the embodiment shown in FIGS. 3A and 3B, a rigid pipe 6*a* just like as a metallic pipe is newly embedded to be fixed inside the hole 6, intending to fixing the stick 3 into the hole 6 more assuredly and firmly than that of the embodiment shown in FIG. 2 wherein an adhesive is pasted directly onto the rubber. A reflection plate L is further coated on a peripheral surface of the upper portion 2 of the tip, intending to effectively reflect rays of light emitted such as from a main light of an automobile vehicle, a street light etc.

The constitution mentioned above can not only guarantee a safe walking even by night but also prevent the tip from unexpectedly dropping out of the stick end.

The reflecting plate L can be manufactured by a colored transparent member formed of a well-known plastic resin which is suitable for coloration, thereby either to attract an attention or to caution a dangerous status such as red, yellow etc. The reflecting plate L might be manufactured by a resin molding technology to have a tapered shape which coincides with the outer shape of the upper portion 2 or, otherwise, might be formed of sectioned constituents of a planar member by adhering to the portion 2 using a paste.

Figure 4:
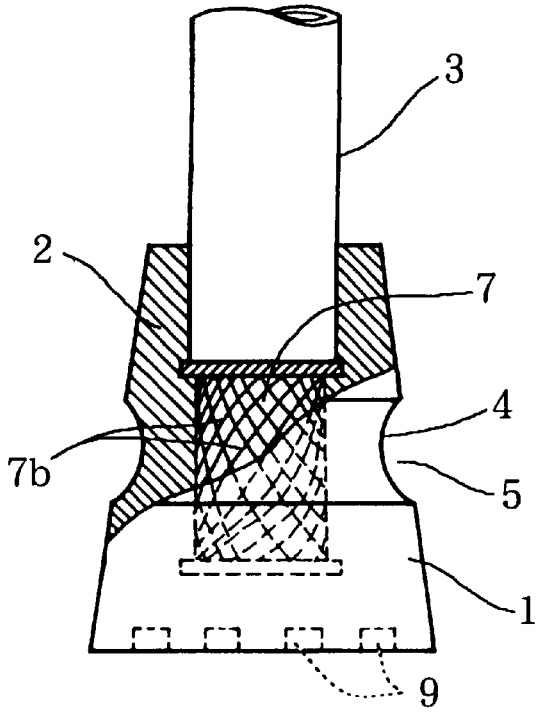
FIG. 4 is further still another partly cross-sectioned side view showing further still another embodiment according to the present invention.
Figure 5A:
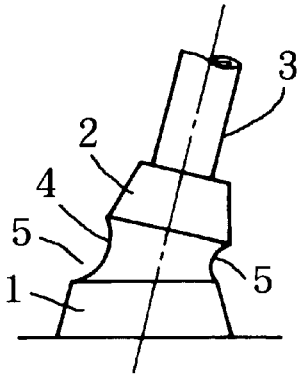
FIGS. 5A, 5B, 5C and 5D are side views for illustrating step by step a flexibly deforming process of the embodiment at a serving status when the tip is applied to a stick.
Figure 5B:
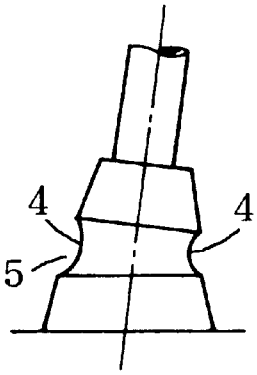
Figure 5C:
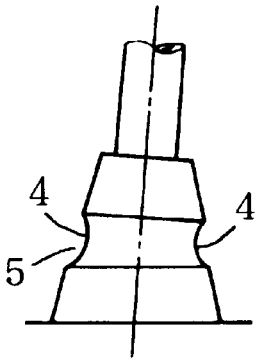
Figure 5D:
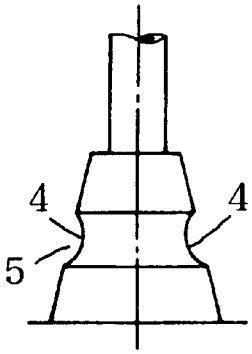

Further in the embodiment shown in the FIG. 4, a cylindrically formed tire cord 7*b*, for instance, is embedded and fixed instead of the coil spring 7*a* shown in FIG. 2. The tire cord 7*b* is preferable to be integrally formed with an outer shell of the tip utilizing the die during molding the rubber. Even in the present embodiment, the circular check plates 8 and 8 are disposed being contacted with an upper end and a lower end of the cord 7*b* as the same as the previous embodiments shown in FIGS. 2 and 3A. Then a hole 6 is opened on a front surface of the upper portion 2 of the tip, whereto the end of the stick 3 is inserted to be applied to a service.

In each figure, 9 stands for an antiskid plane which is unevenly formed on a rear end of the lower portion 1 of the tip.

The rigid pipe 6*a* or the reflecting plate L is optionally employable even to the other embodiments beside the embodiment shown in FIGS. 3A and 3B.

As the present invention is constituted mentioned above, the end of the stick 3 can be firmly inserted and fixed into the hole 6 to be applied to the service.

If the lower portion 1 is contacted with the ground during slantingly using the stick 3, the stick 3 always maintains a contacting status of the portion 1 with the ground without skidding, changing the deforming statases sequentially as can be seen from FIGS. 5A, 5B, 5C and 5D as the user walks on. Herein in FIGS. 5A, 5B and 5C, mainly the annular concavity 5 of the flexibly deformable portion 4 for connecting the lower portion 1 with the upper portion 2 is compressed in an inclined direction of the stick while stretched in an opposite direction resulting in a partial deformation, which can guarantee the user with a stable application of the stick 3 to the service.

Moreover, so long as the coil spring 7*a* or the cord 7*b* is embedded inside the tip as can be seen from the embodiments of the FIGS. 2, 3A, 3B and 4, it can reinforce the elastic material located outside, which enables the application of rubbers having the lower rigidities, resulting in improvement of the flexibility and of the manufacturing cost.

As the technologies according to the present invention constitute monolithically the main body of the tip out of an elastic material, there is neither sliding portion nor discrepancy even when the tip is flexibly deformed, the tip can perfectly shut out invasions of the sand, the rain etc. Accordingly, the material senility and the breakdown of the constituents are prevented so completely that the utilization period of the tip is considerably extensible compared with that of the so far tip. Because of the inherent structural simplicity, the tip according to the present invention can be installed on the lowest end of any favorite stick that the user desires.

When the user applies the stick shod with the tip according to the present invention as an aid for walking, the stick is convenient not only to the aged persons but also to the handicapped persons and even to the rehabilitation of the patients or the injured because the bottom surface of the tip always keeps a contacting status with the ground surface, the deformation of the tip being absorbed by extending and shrinking functions of the annular concavity, no matter what the stick may incline at any angle with respect to the ground. The reflecting plate coated on the outer surface of the tip effectively reflects the rays of light emitted, for instance, by night from the headlights of the automobile vehicles so as to attract attentions of the car drivers, resulting in being capable of preventing unwilling accidents. The rigid pipe embedded inside the tip makes the adhesion and the fixing between the tip and the stick assured, which can prevent the unexpected dropping of the tip out of the stick.

What is claimed is:

1. A flexibly elastic tip for stick use, comprising:

a lower portion of said tip for contacting the ground;

an upper portion of said tip on which a stick-inserting hole to insert said stick into is opened; and a flexibly deforming portion connecting said lower portion and said upper portion which is equipped with an annular concavity having an arc-shaped cross section on a peripheral surface of said flexibly deforming portion for dispersing stress concentrations when the stick is in use, wherein:

said three portions mentioned above are monolithically formed of an elastic material as a whole; and an elastic reinforcement material for reinforcing the flexibly deforming portion of said elastic material is embedded and fixed inside said elastic material.

2. The flexibly elastic tip according to claim 1 wherein:

a rigid pipe is embedded in an inside wall of said hole which is opened on said upper portion of said tip.

3. A stick shod with the tip according to claim 2 on a lowermost end of said stick.

4. The flexibly elastic tip according claim 1 wherein:

a rigid pipe is embedded in an inside wall of said hole which is opened on said upper portion of said tip; and a light reflecting material for reflecting rays of light is coated on an outside surface of said upper portion of said tip.

5. A stick shod with the tip according to claim 4 on a lowermost end of said stick.

6. A flexibly elastic tip for stick use according to claim 1 wherein:

said elastic reinforcement material for reinforcing said flexibly deforming portion, said elastic material is a spring coil.

7. A stick shod with the tip according to claim 6 on a lowermost end of said stick.

8. A flexibly elastic tip for stick use according to claim 1 wherein:

said elastic reinforcement material for reinforcing said flexible deforming portion, said material is a cord.

9. A stick shod with the tip according to claim 8 on a lowermost end of said stick.

10. A stick shod with the tip according to claim 1 on a lowermost end of said stick.

* * * * *